US005162766A

United States Patent [19]

Morris et al.

[11] Patent Number: 5,162,766

[45] Date of Patent: * Nov. 10, 1992

[54] MOLDED CASE CIRCUIT BREAKER WITH INTERCHANGEABLE TRIP CIRCUITS

[75] Inventors: Robert A. Morris, Burlington; Irenaeus S. Panus, New Britain; Roger J. Morgan, Simsbury; Ronald G. Pekrul; Edward J. Collin, both of Southington, all of Conn.

[73] Assignee: General Electric Company, New York, N.Y.

[ * ] Notice: The portion of the term of this patent subsequent to Sep. 26, 2006 has been disclaimed.

[21] Appl. No.: 772,825

[22] Filed: Oct. 7, 1991

[51] Int. Cl.[5] ..... H01H 9/02

[52] U.S. Cl. ..... 335/202

[58] Field of Search ..... 335/202, 131-132, 335/6

[56] References Cited

U.S. PATENT DOCUMENTS

| | | | |
|---|---|---|---|
| 4,041,425 | 8/1977 | Brush et al. | 335/132 |
| 4,227,162 | 10/1980 | Fujita et al. | 335/202 |
| 4,281,359 | 7/1981 | Baver et al. | 361/115 |
| 4,589,052 | 5/1986 | Dougherty | 361/94 |
| 4,622,444 | 11/1986 | Kandatsu et al. | 335/132 |
| 4,728,914 | 3/1988 | Morris et al. | 336/6 |
| 4,754,247 | 6/1988 | Raymont et al. | 335/202 |
| 4,833,563 | 5/1989 | Russell | 361/92 |
| 4,870,531 | 9/1989 | Danek | 361/93 |
| 4,884,048 | 11/1989 | Castonguay et al. | 335/18 |
| 4,912,439 | 3/1990 | Nagy et al. | 335/132 |
| 4,945,327 | 7/1990 | Doughty et al. | 335/201 |
| 4,945,443 | 7/1990 | DeBiasi et al. | 361/93 |
| 4,975,667 | 12/1990 | Morgan et al. | 335/202 |
| 5,053,634 | 10/1991 | Kakinuma | 335/202 |

*Primary Examiner*—Lincoln Donovan
*Attorney, Agent, or Firm*—Richard A. Menelly

[57] ABSTRACT

An industrial-rated circuit breaker cover is adapted for optimally receiving an advanced electronic trip unit including a keypad and display unit as well as a basic electronic trip unit providing circuit interruption facility without the keypad and display unit. The load terminals electrically connect the current sensing transformers with the external power circuit and receive the same size lugs that connect the circuit breaker with the electrical power distribution circuits.

5 Claims, 5 Drawing Sheets

MOLDED CASE CIRCUIT BREAKER WITH INTERCHANGEABLE TRIP CIRCUITS

BACKGROUND OF THE INVENTION

U.S Pat. No. 4,945,327 describes a molded case circuit breaker having a steady state ampere rating of up to 1200 amperes. The circuit breaker operating mechanism is designed for current-limiting wherein the circuit current is interrupted in the early stages of the current waveform to reduce the current let-through during circuit interruption under intense overcurrent conditions. Compact arc chambers are also disclosed for handling the large amount of arc exhaust gases generated during such current-limiting circuit interruption.

The advent of electronic trip circuits in the form of a printed wire board mounted within the circuit breaker cover has been met with immediate commercial success. A circuit breaker of uniform geometry employing an electronic trip unit is adapted for a wide range of circuit breaker ampere ratings by selection of an ampere rating plug that is either factory or field-installable.

A so-called "basic" electronic trip circuit in the form of an integrated circuit contained within a compact printed wire board is described within U.S. Pat. No. 4,589,052. The trip unit is capable of predetermined circuit interruption under so-called "long time", "short time" and "instantaneous" overcurrent conditions. External adjustment to the trip unit circuit to set the circuit overload current values and the associated time delays is made by means of rotary switches mounted on the circuit breaker cover.

U.S. Pat. Nos. 4,870,531 and 4,945,443 disclose more advanced electronic trip units whereby the circuit overload current values and time delays are adjusted by means of a keypad and display unit mounted within the circuit breaker cover. The more advanced circuitry provides metering and control function along with basic overcurrent protection.

To allow for the customer-selection of the different overcurrent trip units, it would be desirable to use a uniform circuit breaker design capable of accepting either of the two electronic circuits available.

Accordingly, one purpose of the instant invention is to provide an industrial-rated circuit breaker where the trip unit can be selected and field-installed without requiring modification to the circuit breaker enclosure. Three current transformers are used with the electronic trip units to determine the circuit current and provide such information to the trip units. U.S. Pat. No. 4,281,359 describes the assembly of the electronic trip unit on the current transformers with the load terminal connectors passing through the current transformers to form the primary winding.

The provision of the current transformers at the load terminal end of the circuit breaker enclosure raises the height requirements of the load terminal lug that connect with the circuit breaker load terminals somewhat higher than the lugs used for connecting with the line terminals at the line terminal end of the circuit breaker.

Accordingly, a further purpose of the invention is to provide a transformer load terminal assembly capable of accepting the same-sized lugs that are used at the line end of the circuit breaker.

SUMMARY OF THE INVENTION

A circuit breaker having field-installable accessories and field-installable rating plugs further allows the trip unit to be field-installed as a customer option. The trip unit recess within the circuit breaker cover directly accepts an advanced trip unit circuit including an operator-accessible keypad and display unit. The same circuit breaker also receives a basic electronic trip unit within an adapter plate for field-installable installation without modification to the circuit breaker cover or interior. A load terminal lug assembly at the load end of the circuit breaker connects between the external electrical circuit and the current sensing transformers with an overall geometry similar to the line terminal assembly at the line end of the circuit breaker.

DESCRIPTION OF THE PREFERRED EMBODIMENT

Figure 1:
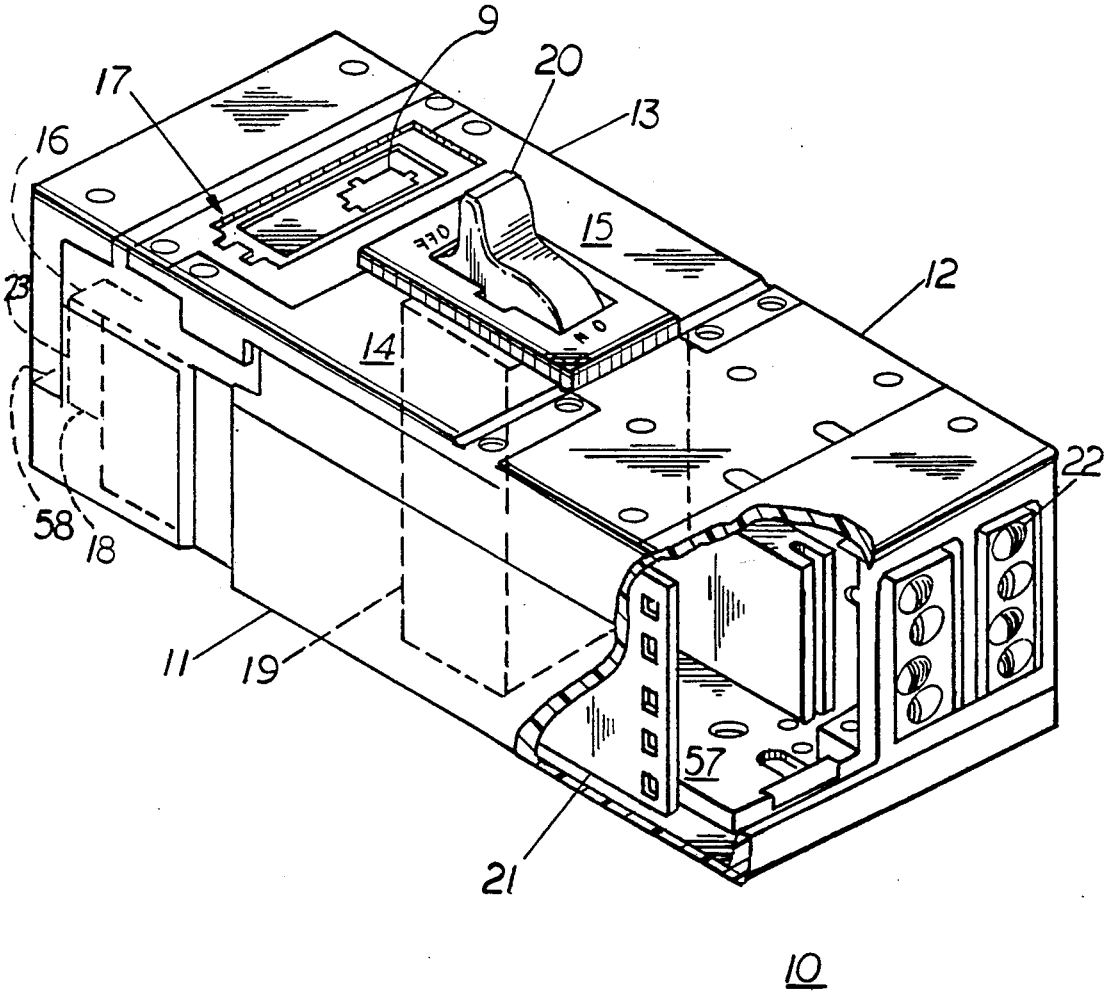
FIG.1 PRIOR ART
FIG. 1 is a top perspective view of an industrial-rated circuit breaker in accordance with the prior art.

An industrial-rated circuit breaker 10 is shown in FIG. 1 and includes a molded plastic case 11 to which a cover 12 and accessory cover 13 are fixedly secured. The operation of the circuit breaker is described within U.S. Pat. No. 4,975,667 and the function of the accessory cover is described in U.S. Pat. No. 4,754,247. A pair of accessory doors 14, 15 house field-installable accessories as well as the combined trip actuator and accessory module that interacts with the electronic trip unit to interrupt the circuit current. A good description of the trip actuator accessory module is found in U.S. Pat. No. 4,833,563 and one example of an auxiliary switch accessory unit is found in U.S. Pat. No. 4,912,439. The electronic trip unit 16 is of the "advanced" state-of-the-art wherein a keypad and display unit 17 are accessible from the exterior surface of the circuit breaker cover providing both overcurrent protection and metering facility to the circuit breaker. The rating plug 9 allows a common circuit breaker enclosure to be used over a wide range of ampere ratings as described, for example, in U.S. Pat. No. 4,728,914. The circuit breaker is connected with the electrical distribution system by means of the line terminal lugs 22 at one side of the breaker and by means of the current transformer-load terminal assembly 18 which connects with the associated electrical load by means of the load lugs 23 at the opposite end of the circuit breaker. The circuit breaker contacts (not shown) are automatically interrupted under overcurrent conditions by means of the circuit breaker operating mechanism 19 and are separated by means of manual intervention under quiescent operating conditions by means of the operating handle 20 extending through the circuit breaker cover. The arc that occurs when the circuit breaker contacts are separated under intense overcurrent conditions is rapidly extinguished by means of the arc assembly 21 immediately ahead of the line terminal lugs 22 at the line end of the circuit breaker.

Figure 2:
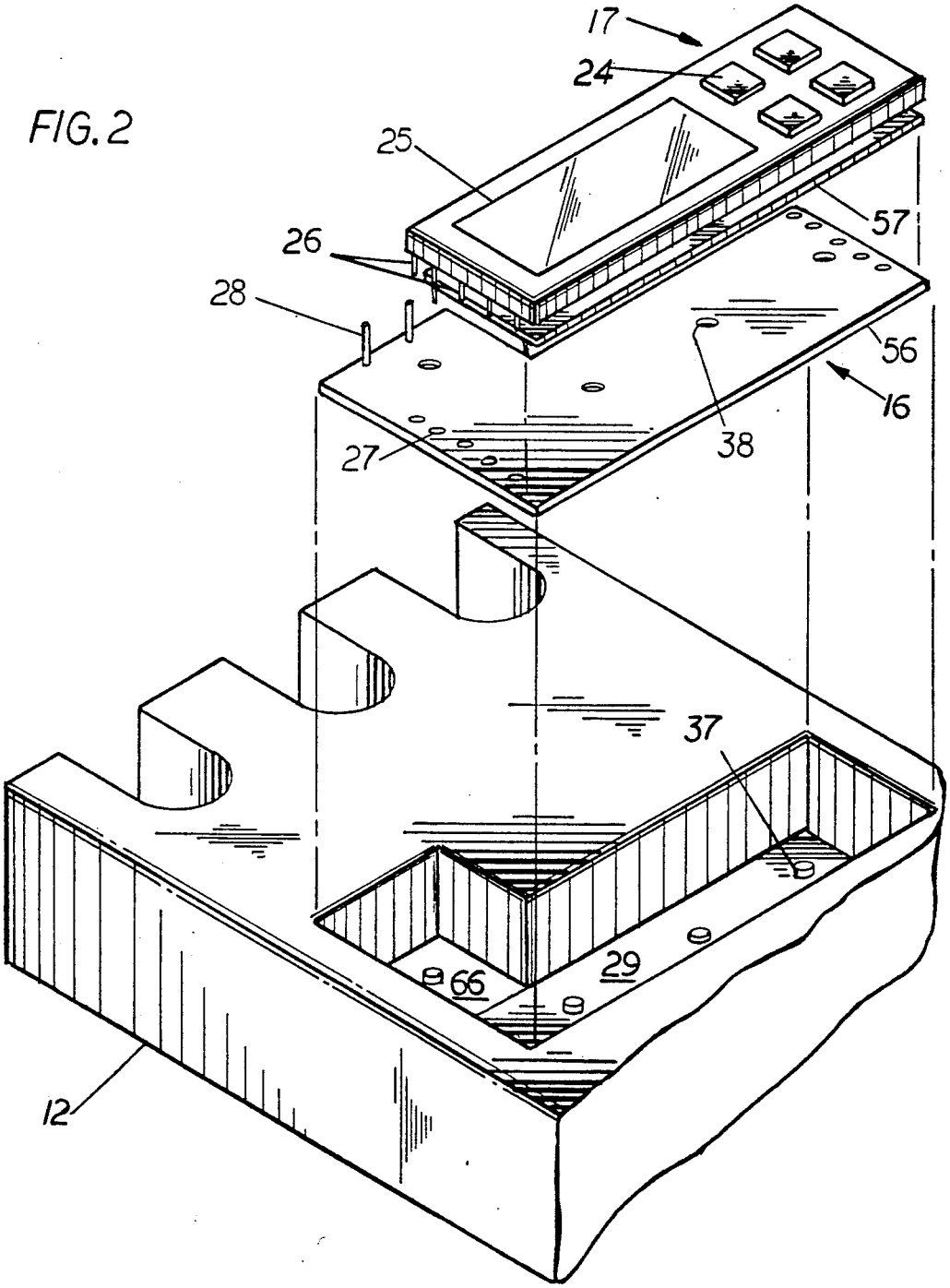
FIG. 2 is a top perspective view of a part of the circuit breaker cover of FIG. 1 with an advanced trip unit in isometric projection prior to assembly.

As best seen by referring now to FIG. 2, the advanced electronic trip unit 16 includes an overcurrent protection circuit board 56 along with a metering and display circuit board 57 connected together. The trip unit is in the form of an L-shaped configuration and supports the keypad and display unit 17 with the keypad 24 to one side of the display 25 as indicated. The keypad and display unit electrically connects within the advanced electronic trip unit 16 by means of pins 26 extending from the bottom of the keypad and display unit and the sockets 27 formed within the overcurrent protection circuit board 56. The advanced electronic trip unit 16 with the keypad and display unit 17 attached thereto is positioned within a corresponding L-shaped recess 29 formed within the circuit breaker cover 12. To accurately position and support the advanced electronic trip unit within the recess, a plurality of spaced projections 37 are integrally-formed therein and are captured within the corresponding thru-holes 38 formed within the advanced electronic trip unit 16, as indicated. With the advanced electronic trip unit assembled within the corresponding L-shaped recess 29, the pin connectors 28 upstanding from the advanced electronic trip unit are positioned within the accessory actuator unit recess 66 for receiving the actuator accessory unit and electrically connecting therewith. The advanced electronic trip unit 16 is of the type described within the aforementioned U.S. Pat. Nos. 4,870,531 and 4,945,443.

Figure 3:
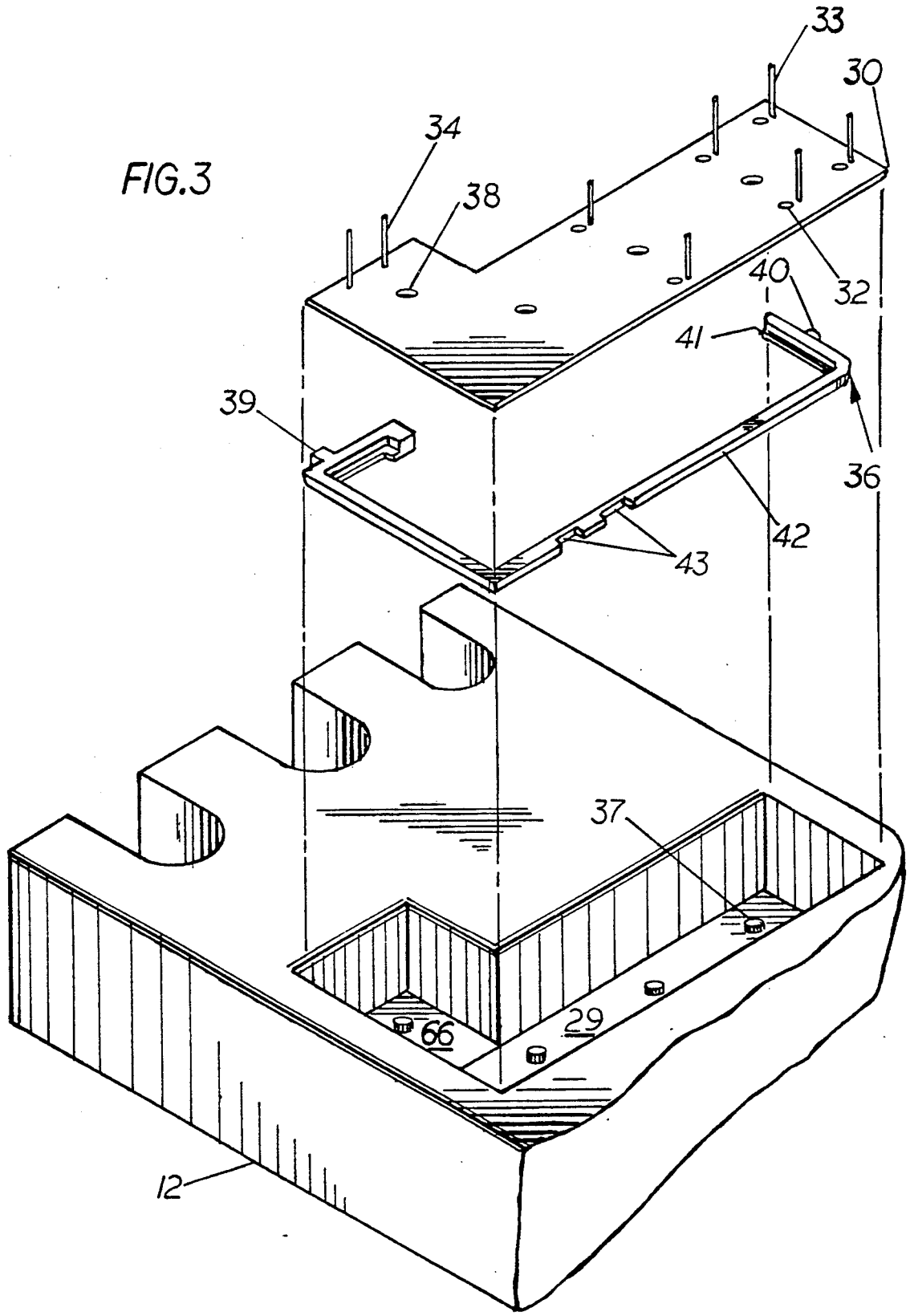
FIG. 3 is a top perspective view of a part of the circuit breaker cover of FIG. 1 with a basic electronic trip unit in isometric projection prior to assembly.

The so-called "basic" electronic trip unit described earlier with reference to U.S. Pat. No. 4,589,052 is depicted at 30 in FIG. 3 prior to insertion within the same-sized L-shaped recess 29 formed in the circuit breaker cover 12. The basic trip unit is also L-shaped such that the upstanding pins 34 electrically connect with the actuator-accessory unit when later assembled within the actuator-accessory unit recess 66. The pins 33 upstanding from the top surface of the trip unit electrically connect with the circuit breaker current transformers by means of the thru-holes 32 formed within the trip unit and connected therewith by the method described in U.S. Pat. No. 4,884,048. The trip unit also includes a plurality of spaced thru-holes 38 to capture the upstanding projections 37 in the L-shaped recess 29 in the manner described earlier with reference to FIG. 2. To accommodate the positioning of the trip unit within the recess, an adapter plate 36 is provided in accordance with the teachings of this invention. The adapter plate comprises a unitary base 42 formed of a plastic material and which includes a perimetric slot 41 formed on the interior surface thereof. The trip unit 30 fits within the perimetric slot such that when the trip unit and adapter plate are positioned within the L-shaped slot 29 the thru-holes 38 are exactly positioned over the projections 37. The rectangular projection 39 extending from one side of the base 42 positions the adapter plate 36 within the accessory-actuator unit recess 66 while the radial projection 40 extending from another side of the base positions the edge of the adapter plate within the L-shaped recess 29. The rectangular slots 43 formed along the outside edge of the longest side of the adapter plate allow for the egress of the wire conductors (not shown) which extend from the trip unit to provide electrical connection between the trip unit and external electrical circuitry.

Figure 4:
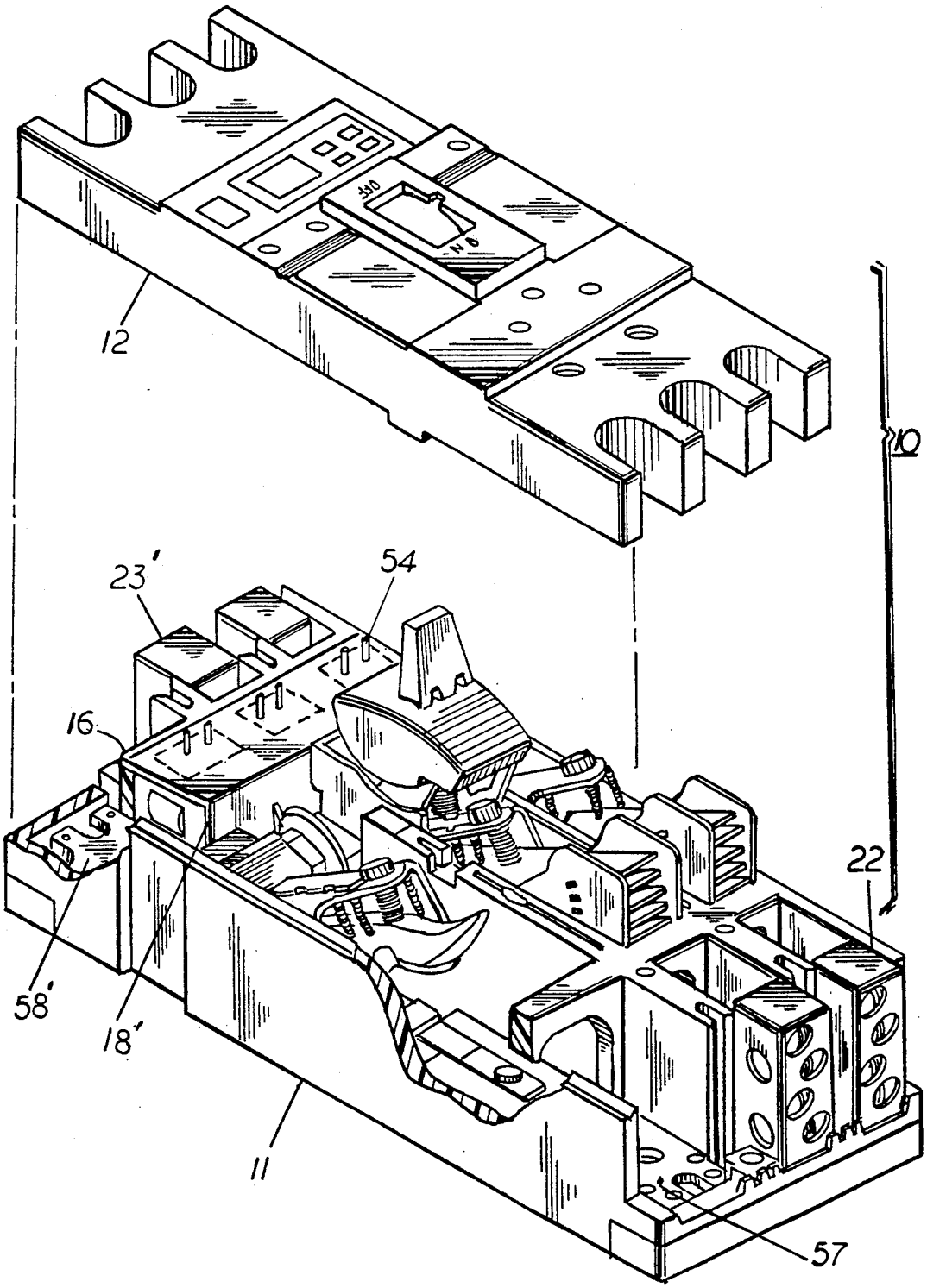
FIG. 4 is a top perspective view in isometric projection of the circuit breaker of FIG. 1 containing a modified transformer-load terminal assembly in accordance with the invention.
Figure 5:
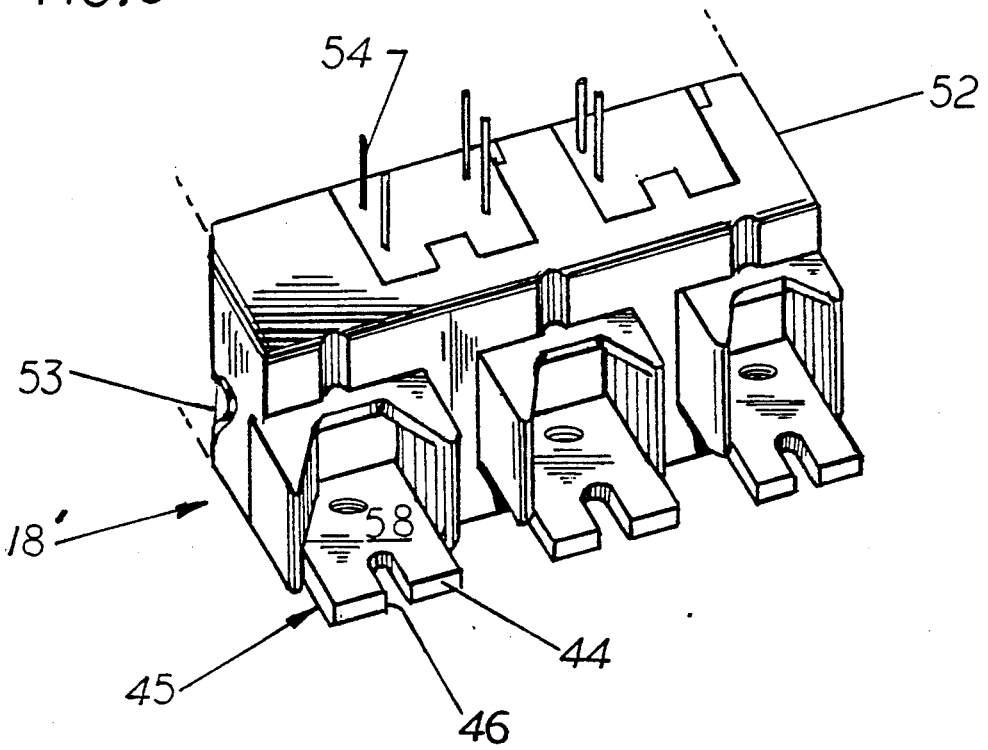
FIG. 5 is a top perspective view of the transformer-load terminal assembly within the circuit breaker of FIG. 4.

In briefly referring back to the prior art circuit breaker 10, depicted in FIG. 1, it is noted that the line terminal surface 57 that receives the line terminal lugs 22 is lower than the load terminal surface 58 that receives the load terminal lugs 23. This prevents field installation of a common line and load terminal lug as used with other industrial-rated circuit breakers. The circuit breaker 10, depicted in FIG. 4, is similar to that described earlier with reference to FIG. 1 in which a cover 12 is attached to the case 11 and differs from that depicted earlier by the provision of a load terminal surface 58' that is co-planar with the line terminal surface 57. This allows the load terminal lugs 23' to be identical with the line terminal lugs 22 and greatly facilitates field-installation thereof. This is accomplished by the provision of a current transformer-load terminal assembly 18' that is best seen by referring now to both FIGS. 5 and 6.

The current transformer-load terminal assembly 18' is similar to that described within the aforementioned U.S. U.S. Pat. No. 4,281,359 wherein the load terminal assembly 45 includes the load terminal connector portion 44 with the co-planar load terminal surface 58', described earlier. The transformer windings 53 are contained within a plastic housing 52 through which the transformer pin connectors 54 extend for connection with the electronic trip unit 16 as shown, for example, in FIG. 4. An anti-turn slot 46 cooperates with a projection (not shown) extending from the bottom of the load terminal lugs to facilitate attachment between the load terminal lug and to prevent the load terminal lug from rotation upon occurrence of severe overcurrent conditions.

Figure 6:
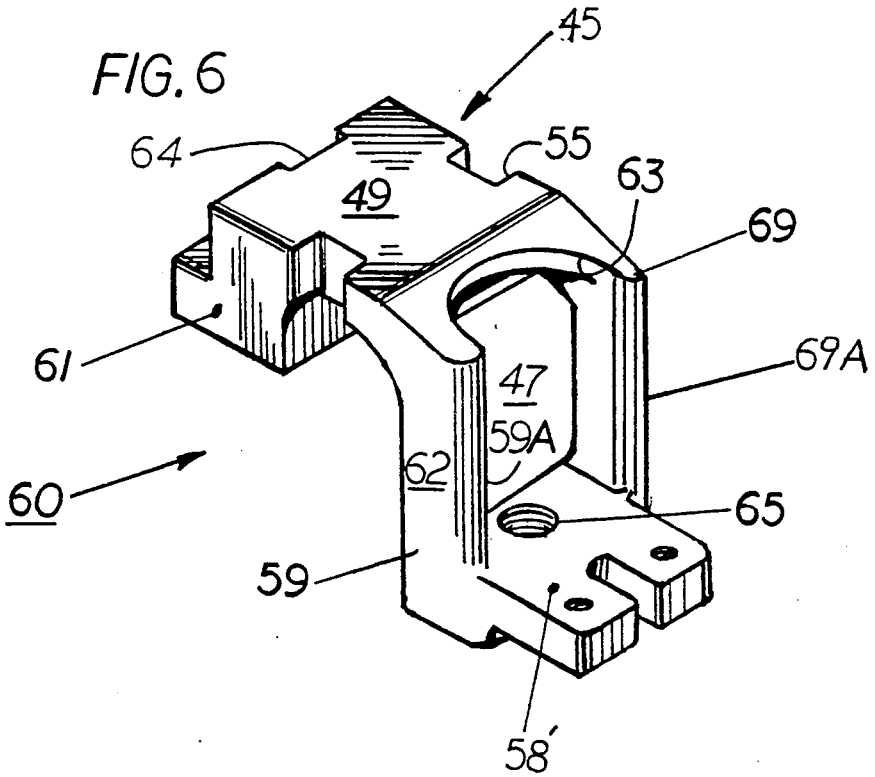
FIG. 6 is an enlarged top perspective view of the load terminal used with the transformer-load terminal assembly of FIG. 5.

As best seen by referring to the load terminal assembly 45 depicted in FIG. 6, the overall inverted U-shaped configuration 60 defines a pair of upstanding legs 61, 62 joined by a current transformer bar conductor or bight 49. A pair of side pieces 59, 69 upstanding from the load terminal surface 58' cooperate with the bight 49 to provide thermal transfer away from the current transformers in a heat-sink relation. The heat is transferred away from the side pieces by the finned ends 59A, 69A designed for optimum thermal convection. The rectangular slots 55 formed within the bight accept the magnetic core pieces formed within the associated current transformers of FIG. 5. The coextensive U-shaped slot 63 along the upstanding legs 62, 69 provides clearance for the load connector and optimizes air flow through the slot 47 formed between the side pieces 59, 69 to enhance the thermal convection properties of the fins 59A, 69A. The threaded opening 65 formed within the load terminal surface 58' provides for attachment of the load terminal lugs 23' (FIG. 4). The coextensive rectangular slot 64 along the back surface of the upstanding leg 61 provides access to the threaded opening used to connect the load terminal assembly to the movable contact assembly (not shown).

It is thus seen that the overall shape of the load terminal assembly interfaces with the current transformers and load connectors to provide excellent electrical transfer while further providing sufficient heat transfer to allow continuous current to flow to the circuit breaker without overheating upon overload current conditions.

Having thus described our invention, what we claim as new and desire to secure by Letters Patent is:

1. A circuit breaker having interchangeable electronic trip units comprising:

a molded plastic case and cover attached together to form an enclosure;

a pair of contacts within said enclosure arranged for automatic separation upon occurrence of an overcurrent condition through a protected circuit;

an electronic trip unit arranged on a printed circuit board positioned within a recess formed within said cover;

an operating mechanism within said enclosure causing said automatic separation upon interaction with said electronic trip unit;

an adapter unit interfacing between said printed circuit board and said recess sized to to accurately position said printed circuit board within said recess, said adapter unit comprising a support piece defining an open slot; and a plurality of projections upstanding within said recess and a plurality of thru-holes formed through said printed circuit board, said projections extending through said thru-holes for accurately positioning said printed circuit board within said recess.

2. The circuit breaker of claim 1 wherein said support piece further includes a perimetric slot formed within an outer perimeter of said support piece around said open rectangular slot.

3. The circuit breaker of claim 2 wherein an outer edge of said printed circuit board is arranged within said perimetric slot.

4. The circuit breaker of claim 1 wherein said cover recess defines an L-shaped configuration.

5. The circuit breaker of claim 1 wherein said printed circuit board comprises an L-shaped configuration.

* * * * *